US005794853A

United States Patent [19]

Perkins

[11] Patent Number: 5,794,853

[45] Date of Patent: Aug. 18, 1998

[54] INSTITUTIONAL SPRINKLER HEAD NIPPLE

[76] Inventor: Lloyd Perkins, 2008 Scottwood Ave., Toledo, Ohio 43612

[21] Appl. No.: 692,763

[22] Filed: Aug. 6, 1996

[51] Int. Cl.[6] ..... B05B 15/06

[52] U.S. Cl. ..... 239/208; 239/600

[58] Field of Search ..... 239/200, 201, 239/208, 209, 600; 169/37, 41; 285/65; 137/357; 248/75; 52/168

[56] References Cited

U.S. PATENT DOCUMENTS 3,061,015 10/1962 Cann, Jr. ..... 169/41
4,007,877 2/1977 Jackson et al. ..... 239/209

*Primary Examiner*—Lesley D. Morris

*Attorney, Agent, or Firm*—William G. Lane

[57] ABSTRACT

An institutional sprinkler head nipple adapted to place an assembly of the institutional sprinkler head and a nipple in an institutional wall by placing the nipple and the sprinkler head under tension between one side of the wall and the other side of the wall. The improved fire sprinkler nipple comprising a cylindrical hollow pipe of a first internal diameter and a first outer diameter and having first and second ends, the wall of the pipe being swaged down towards the first end to the cylindrical section of a second inner diameter less than the first inner diameter of the pipe, the first end being internally threaded and adapted to receive an externally threaded inlet of an institutional fire sprinkler head, the second end adapted to be joined with a fire sprinkler pipe fixture, a cylindrical externally threaded sleeve is received on and secured on the pipe proximate its first end, the sleeve adapted to receive a retaining washer and threaded nut.

21 Claims, 2 Drawing Sheets

INSTITUTIONAL SPRINKLER HEAD NIPPLE

FIELD OF THE INVENTION

The present invention relates to assemblies for fire protection sprinkler systems, and more particularly, to a fire protection sprinkler system nipple assembly.

DESCRIPTION OF THE PRIOR ART

In the fire protection industry, a sprinkler system is generally defined as a means for automatically extinguishing or controlling a fire in its early stages by an integrated system of piping fitted with devices, typically fire sprinklers, which operate automatically in case of fire through the action of heat sensitive elements. The portion of the sprinkler system above ground is a network of specially sized or hydraulically designed piping installed in a building, structure, or area, generally overhead or in the wall near the ceiling, and to which sprinklers are attached in a systematic pattern. Each sprinkler system includes a device for actuating an alarm when the system responds to a fire. The system is usually activated by heat from a fire and discharges water over the area of the fire. The value of fire protection sprinkler systems is well documented. In the United States, there has never been a documented accidental death from a fire in a structure which is equipped with an operating sprinkler system fire protection sprinkler system not only saves lives, it also greatly reduces the property damage from the fire. The sprinkler system broadcasts a spray or mist of water which cools the air about the area of the fire, wets combustible material making it incapable of supporting combustion, and frequently douses the fire before the fire fighting crew responds to the alarm. No skyscraper, i.e., a building 12 or more stories, that has been equipped with an operating fire protection sprinkler system has had a major fire in the U.S. In contrast, there have been a number of major fires in skyscrapers and high rise buildings, both in the U.S. and abroad, that did not have an operational fire protection sprinkler system. In several of these fires, several floors have been completely burned out and the integrity of the steel structure or frame has been placed in question due to the heat of the fire.

There are several types of fire protection sprinkler systems which principally use spray sprinklers for discharge nozzles. Some of these systems include: the wet pipe system in which the piping is charged with water under pressure; the dry pipe system in which the piping is charged with air under pressure but into which water is automatically admitted when a sprinkler opens in response to a fire (this system is used where the system can be subject to freezing conditions); the deluge system in which pipes are normally empty and open at the heads and a heat sensitive feature is a separate network of heat detectors which control the flow of water; and the system in which there is a separate network of pipes and sealed heads used with pneumatic or electrical detectors that control the introduction of water into the distributive system.

Because of the safety record of buildings which have operating fire protection sprinkler systems, almost all institutional facilities such as governmental correction facilities (i.e., prisons), heath facilities (i.e., hospitals and mental health facilities), care facilities (i.e., care facilities for the elderly) and educational facilities are required by law to have an operating fire sprinkler system. In many of these facilities, residents, inmates or patients experience episodes where they will attempt to be as destructive as possible causing harm to themselves, harm to other patients, inmates or patients and causing damage to the facility.

It was learned early, that the conventional fire protection sprinkler systems are particularly prone to damage by destructive forces and when the sprinkler head is activated or the sprinkler head was successfully removed from the sprinkler head nipple or the sprinkler head and nipple assembly were successfully removed from the header, the resulting facilities damage from the water flow was substantial. Not only was the water flow from the damaged system destructive to the facility, but it placed the entire facility in danger because it lowered the water pressure of the entire fire protection sprinkler system which could render the system ineffective in the event of a fire elsewhere in the facility.

The fire protection sprinkler system industry was quick to respond to this problem and developed a tamper proof sprinkler head which is used in virtually all institutional facilities. These are designed so that they cannot be forced open without special tooling. They are virtually impossible to grasp with the hand when mounted on a wall because they have a smooth beveled protective housing. Their design is intended to prevent the sprinkler head from being unscrewed from the nipple or the sprinkler head and nipple assembly from being unscrewed from the header. However, when a resident, inmate or patient can grasp the sprinkler head from the front and back of the sprinkler head housing, sprinkler heads have been removed from the nipple, or the head and nipple assembly have been removed from the header or the header system has been damaged by vigorous shaking of the sprinkler head and nipple assembly. Accordingly, in institutional facilities it is highly desirable to secure or tighten the institutional sprinkler head to the wall to prevent one from grasping the sprinkler head or shaking it.

The minimum requirements for the design and installation of automatic sprinkler systems is governed by the Standards of the National Fire Protection Association for the Installation of Sprinkler Systems, NFPA No. 13. This includes the character and adequacy of water supplies and the specifications for sprinkler heads, piping, valves, fixtures and all materials and accessories.

In most fire protection sprinkler systems, the headers or distributive branch lines with which the sprinkler heads are associated extend generally horizontally throughout the location to be served, for example, in the ceiling or in the wall near the ceiling. For overhead systems, it is frequently desirable or necessary to have some or all of the sprinkler heads mounted on the lower ends of lengths of generally vertical pipe ("drop nipples") which have their upper ends connected to the header. This would be the arrangement, for example, where a false ceiling is employed through which only the sprinkler heads extend, the header above being concealed. For institutional use, in prisons or mental health hospitals, the sprinkler heads are normally mounted on nipples extending through bores in the walls from a pipe case or utility corridor behind the wall.

When an automatic sprinkler system is being installed overhead in a building under construction, a plurality of headers which are to be connected to a water main or other source of water under pressure are installed in generally parallel relationship with each other before the ceiling is constructed. Each of the headers include a plurality of vertically disposed drop nipples having pipe threads on one end which are connected to the header, and such drop nipples generally extend downwardly through an imaginary line which is indicative of the location of the finished ceiling. When the ceiling is being constructed, the plaster board, acoustic tile or other ceiling material is provided with holes through which the lower ends of the drop nipples project. After the ceiling is substantially completed, the drop nipples are measured, taken out, cut off and threaded, supplied with the desired sprinkler head, and are reconnected to the concealed headers or branch lines. A sprinkler system may contain many hundreds of such headers and drop nipples, with a significant labor cost associated with the fabrication and assembly of the total number of such drop nipples.

Under Section 7-1.1.2 of the NFPA No. 13, pipe sizes for fire protection sprinkler systems are required to be no less than one inch nominal internal diameter for the drop nipples at the point of connection with the header. The size of piping for the piping distribution system, number of sprinklers per header, the number of headers per cross main are otherwise limited only by the available water supply.

The sprinkler head themselves, however, are generally provided with a one-half inch or three-quarter inch inlet with male threads for connection to a drop nipple assembly. Accordingly, conventional nipples have heretofore generally been comprised of a one inch constant diameter pipe section with one end threadedly connected to the header or branch line, and the other end threadedly connected to a one inch by one-half inch or three-quarter inch female threaded reducing union. The sprinkler head is threadedly connected to the reducing union.

Conventional nipples have several shortcomings. As mentioned above, the assembly of the reducing union to the one inch diameter pipe section requires a significant expenditure of time, especially in view of the potentially large number of nipples required in a given sprinkler system. The assembly of the nipples and reducing unions thus can account for a significant portion of the total installation cost of fire protection sprinkler systems.

Furthermore, the joint between the reducing union and the nipple provides a potential leak path. The NFPA guidelines, Section 1-11.2.2, dictate that inside sprinkler piping shall be installed in such a manner that there will be no visible leakage when the system is subjected to a hydrostatic pressure test. The more threaded joints a system has, the more likely the completed fire protection sprinkler system will have a leak. The elimination of the reducing union from the from nipple assembly will reduce the number of threaded joints by almost 25% for most fire protection sprinkler systems. The elimination of this joint not only reduces potential leaks but also reduces the number of joints an institutionalized person can attempt to break or loosen.

In addition, as will be appreciated by those skilled in the art, a nipple assembly is susceptible to corrosion at its weakest point. With the conventional drop nipple assembly the first exposed thread at the joint between the reducing union and the one inch diameter pipe section is the weakest point and is susceptible to corrosion.

Finally, the fluid path at the joint between the reducing union and the one inch diameter pipe section is somewhat discontinuous, causing turbulent flow through the conventional nipples. This increases hydraulic friction losses and reduces flow through the nipple assembly and the sprinkler head.

SUMMARY OF THE INVENTION

The present invention is directed to an improved fire sprinkler nipple for fire sprinkler heads for institutional facilities comprising a cylindrical hollow pipe of first inner diameter and first outer diameter having first and second open ends, said cylindrical pipe being swaged down at its front end to a cylindrical section of a second inner diameter less than the first inner diameter of said pipe, the first open end being internally threaded and adapted to receive an externally threaded institutional fire sprinkler head, the second open end adapted to be joined with a fire sprinkler pipe fixture; and a cylindrical externally threaded sleeve having an inner diameter slightly greater than the first outer diameter of the cylindrical hollow pipe, said sleeve received on and secured to said pipe proximate its second open end, the sleeve adapted to receive a retaining washer and threaded nut to place the nipple under tension between an institutional fire sprinkler head joined to said first open end and the retaining washer and threaded nut. The sprinkler head is mounted on one side of an institutional wall, the nipple extends through a bore in the wall, and the washer is mounted on the other side of the wall.

The second open end is normally externally threaded to be received within an internally threaded fire sprinkler pipe fixture, such as header, T-connection, elbow or the like. Alternatively, the second open end of the fire sprinkler nipple can be internally threaded and adapted to receive an externally threaded outlet of a fire sprinkler pipe fixture. The second open end of the nipple can be unthreaded adapted to be joined to a VICTAULIC® type grooved end/rubber gasket pipe coupling or similar type pipe joint.

The threaded sleeve can be secured to the pipe by conventional means, such as, lock screws, sweat soldering, spot welding, swaging a section of the sleeve into the outer surface of the pipe or by a bead weld between the edge of the sleeve and the outer surface of the pipe.

The present invention is also directed to an institutional fire sprinkler head assembly comprising an institutional fire sprinkler head having an externally threaded inlet; a nipple comprising a hollow pipe having a constant diameter cylindrical wall section with an open first or back end, a cylindrical outlet section having an open second or front end and a swaged cylindrical wall section adjoining the cylindrical wall section and the cylindrical outlet section, the first end of said pipe being swaged down by the swaged cylindrical wall section to the cylindrical outlet section, the open second end being internally threaded and threadedly receiving the externally threaded inlet of said sprinkler head, the first end adapted to be joined with a fire sprinkler pipe fixture, and a hollow externally threaded sleeve received on and secured to the constant diameter cylindrical wall section of said pipe; a retainer washer removably received on said threaded sleeve; and an internally threaded nut threadedly received on said sleeve, the assembly adapted to be secured to a wall through a bore in the wall wherein the institutional fire sprinkler head is positioned on one side of the wall about the bore, the nipple extending through the bore to the other side of the wall, the washer positioned on the other side of the wall about the bore and received on the sleeve, and the nut tightened on the sleeve to place the sprinkler head and the washer in tension with respect to each other and the wall and thus secure the assembly to the wall. In the preferred embodiment, the nut is a lock nut.

In another embodiment of the present invention, the invention is directed to an improved fire sprinkler nipple for institutional fire sprinkler heads comprising a cylindrical hollow pipe having a substantially constant inner diameter and outer diameter, an inlet end and an open outlet end, the open inlet end being externally threaded and adapted to receive a reducing coupling, the open outlet end adapted to be joined with a fire sprinkler pipe fixture; and a cylindrical externally threaded sleeve having an inner diameter slightly greater than the outer diameter of the cylindrical hollow pipe, said sleeve received on and secured to said pipe, the externally threaded sleeve adapted to receive a retainer washer and internally threaded nut.

Another embodiment of the present invention is directed to an assembly of an improved nipple for an institutional fire sprinkler head that can be securely mounted to the wall of an institutional facility comprising an institutional fire sprinkler head having an externally threaded inlet; a reducing coupler having an internally threaded outlet of a first internal diameter which is threadedly connected to the externally threaded inlet of the sprinkler head and an internally threaded inlet of a second internal diameter; a nipple comprising a hollow pipe having a constant internal diameter and a constant external diameter with an open inlet end and an open outlet end, the open outlet end of the pipe being externally threaded and threadedly connected to the inlet end of the reducing coupler, the open inlet end of the hollow pipe adapted to be joined with a fire sprinkler pipe fixture, a hollow externally threaded sleeve received on and secured to the hollow pipe; a retainer washer removably received on said threaded sleeve; and an internally threaded nut threadedly received on said sleeve, the assembly adapted to be secured to an institutional wall through a bore in the wall wherein the institutional fire sprinkler head is positioned on one side of the wall about the bore with the back of the institutional fire sprinkler head positioned and mounted on the wall, the reducing coupler in the bore and nipple extending through the bore to the other side of the wall, the washer positioned on the other side of the wall about the bore and received on the sleeve, and the nut tightened on the sleeve to place the sprinkler head and the washer in tension with respect to each other and the wall and thus secure the assembly to the wall. In the preferred embodiment, the nut is a lock nut.

In the preferred embodiments of the present invention, the institutional fire sprinkler head assemblies have a marker on the outer surface of the cylindrical wall section between the back end of the sleeve and the first open end of the cylindrical wall section to be used as a marker to indicate the orientation of the institutional fire sprinkler head with respect to the orientation of the nipple. Institutional fire sprinkler heads must be oriented properly to operate properly. The installer, on the back side of the institutional wall opposite the front side of the wall where the sprinkler head is mounted cannot see the sprinkler head to determine its orientation. The marker on the nipple provides a means for determining the orientation of the sprinkler head even though the installer cannot see the head and eliminates the need for a second installer to orient the sprinkler head during installation by the fist installer behind the wall in the utility corridor. The marker is a physical marker on the outer surface of the cylindrical wall section, such as a paint spot, an embossed mark, a file mark, a spot weld and the like. Conveniently, it is a paint spot.

The present invention is also directed to a fire sprinkler protection system comprising a water main; a piping distribution system from the water main to a plurality of headers, each header having a plurality of fire sprinkler pipe fixtures, each fire sprinkler pipe fixture connected to a nipple/institutional fire sprinkler head assembly securely mounted in an institutional wall; a nipple comprising a hollow pipe having a constant diameter cylindrical wall section with an open inlet end, the cylindrical outlet section having an open outlet end, and a swaged cylindrical wall section joining the cylindrical wall section and the cylindrical outlet section, said pipe being swaged down by the swaged cylindrical wall section to the cylindrical outlet section, the open outlet end being internally threaded and threadedly receiving the externally threaded inlet of an institutional sprinkler head, the inlet end being joined to one of the fire sprinkler pipe fixtures, and a hollow externally threaded sleeve received on and secured to the constant diameter cylindrical wall section of said pipe; a retainer washer removably received on said threaded sleeve; and an internally threaded nut threadedly received on said sleeve, the assembly secured to an institutional wall through a bore in the wall wherein the institutional fire sprinkler head is positioned on one side of the wall about the bore, the nipple extending through the bore to the other side of the wall, the washer positioned on the other side of the wall about the bore, and the assembly secured to the wall by tightening the nut on the sleeve and placing the sprinkler head and the washer in tension with respect to each other.

The present invention is also directed to a fire sprinkler protection system comprising a water main; a piping distribution system from the water main to a plurality of headers, each header having a plurality of fire sprinkler pipe fixtures, each fire sprinkler pipe fixture connected to a nipple/institutional fire sprinkler head assembly securely mounted in an institutional wall, a nipple comprising a hollow pipe having a constant internal diameter and a constant external diameter with an open inlet end and an open outlet end, the open outlet end being externally threaded and threadedly receiving the internally threaded inlet end of the reducing coupler, the inlet end of the hollow pipe being joined to one of the fire sprinkler pipe fixtures, and a hollow externally threaded sleeve received on and secured to the hollow pipe; a retainer washer removably received on said threaded sleeve; and an internally threaded nut threadedly engaging the external threads of said sleeve, the assembly secured to an institutional wall through a bore in the wall wherein the institutional fire sprinkler head is positioned and mounted on one side of the wall about the bore, the reducing coupler in the bore, and the nipple extending through the bore to the other side of the wall, the washer positioned on the other side of the wall about the bore and received on the sleeve and the assembly secured to the wall by tightening the nut on the sleeve and placing the sprinkler head and the washer in tension with respect to each other.

Thus one of the objects of the invention is to provide an improved sprinkler head nipple which can be utilized for securely mounting an institutional fire sprinkler head in the wall of an institutional facility.

Still another embodiment of the present invention is to provide an improved nipple for institutional fire sprinkler heads that can be securely mounted to the wall of an institutional facility to prevent residents, inmates and/or patients of the facility from damaging the sprinkler head, the sprinkler head/nipple assembly and/or the header of the fire protection sprinkler system.

In a further embodiment of the present invention, an improved institutional sprinkler head nipple is provided with a marker for determining the orientation of the nipple with respect to the attached sprinkler head to correctly orient the sprinkler head upon installation.

In another embodiment, there is provided a fire protection sprinkler system comprising a header, a sprinkler head, and a drop nipple providing communication between the header and the sprinkler head. The drop nipple has a main body and two ends formed integrally with the main body, the first end being threadedly connected to the header and the second end being threadedly connected to the sprinkler head. The main body and the first end of the drop nipple are formed with a first, generally uniform internal diameter, and the second end is provided with a second internal diameter which is significantly smaller than the first diameter.

Preferably, the drop nipple is formed to include an integral second end having a smooth, uninterrupted reduction in internal diameter from the first diameter to the second diameter. In a most preferred embodiment, the integral second end of the drop nipple is swaged to form the reduction in diameter.

In a further aspect of the invention, there is provided a double swaged end pipe for forming drop nipples in accordance with the present invention.

It is an object of the present invention to provide a one-piece drop nipple for connecting the sprinkler heads to the headers of a sprinkler system without the need of a reducing union.

Another object of the invention is to provide such nipples which provide a significant cost savings in material and labor over conventional sprinkler system drop nipples.

It is also an object of the present invention to provide a nipple which causes reduced pipe friction losses when compared with conventional drop nipples.

A further object of the invention is to provide such nipples which eliminate the potential leak site present at the joint between the main pipe and the reducer of the conventional drop nipple assembly.

Still another object of the invention is to provide institutional nipples and drop nipples which eliminate the corrosion susceptible outside diameter threading at the joint between the nipple and the reducing union of the conventional nipple assembly, and moves the weakest point on the nipple to its very end.

Other objects and advantages will become more apparent during the course of the following description when taken in connection with the accompanying drawings.

BRIEF DESCRIPTION OF THE DRAWINGS

The above, as well as other advantages of the present invention, will become readily apparent to those skilled in the art from the following detailed description of a preferred embodiments when considered in the light of the accompanying drawings, in which.

DESCRIPTION OF THE PREFERRED EMBODIMENTS

Figure 1:
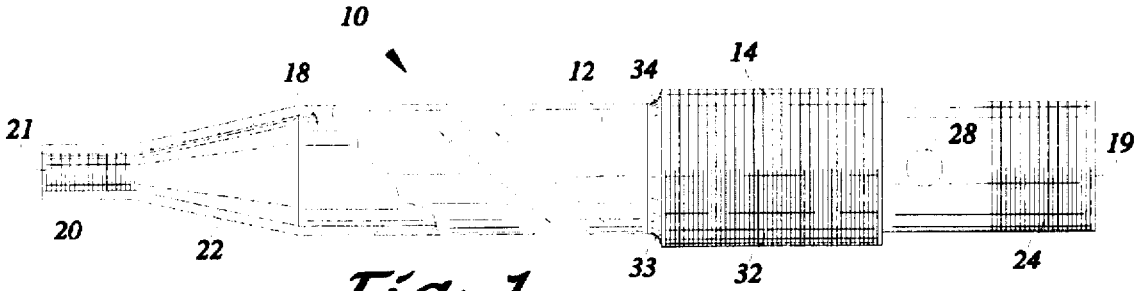
FIG. 1 is a side elevational view, partially in section, of the improved institutional fire sprinkler head nipple.

Referring to FIG. 1, the improved institutional sprinkler head nipple 10 comprises a cylindrical hollow pipe 12 with an attached externally threaded sleeve 14. The cylindrical pipe 12 has a constant diameter hollow cylindrical wall section 18 having an open back inlet 19, a hollow cylindrical outlet section 20 with an open front outlet 21 and a hollow conical shaped swaged wall section 22. The cylindrical wall section 18 bears a paint spot 28 which is used for purposes of orienting an institutional fire sprinkler head 38 as described below. The open outlet 21 is internally threaded to receive the externally threaded male inlet (not shown) of an institutional fire sprinkler head. The cylindrical wall section 18 about the open end 19 is externally threaded 24 so that the nipple can be threadedly connected with the female threads of the outlet of a fire protection pipe fixture, such as a T-connector, header, elbow or the like (see FIG. 2). The externally threaded sleeve 14 has external threads 32 which are adapted to threadedly receive an internally threaded nut (see FIG. 2), preferably a lock nut. The sleeve 14 is adapted to receive a retainer washer (see FIG. 2). The first or front end 33 of the sleeve is faces the open front outlet 21 of said cylindrical outlet section 20. The front end of the sleeve 33 is secured to the outer surface of the wall of the cylindrical wall section 18 by weld bead 34.

The sleeve can be secured to the cylindrical pipe by lock screws threadingly engaging the sleeve and biting into the outer surface of the cylindrical wall section, or by spot welds or a continuous weld at the end of the sleeve to weld the sleeve to the outer surface of the cylindrical wall section or by a press fit between the sleeve and the cylindrical wall section, or by having the portion of the sleeve adjacent to the front end of the sleeve swaged radially inwardly to compress the swaged portion of the sleeve wall against the outer surface of the cylindrical wall section, or by expanding the cylindrical wall section radially outwardly to tightly bond the sleeve to the pipe by friction, or by cementing the inner wall surface of the sleeve to the outer surface of the cylindrical wall with epoxy cement, and the like. So as to not interfere with the threading on of the nut onto the sleeve, the lock screws and welds used to secure the sleeve to the cylindrical wall section are preferably positioned towards the front end of the sleeve. It is to be appreciated that institutional walls will vary in size and that the cylindrical hollow pipe can be cut to various lengths and the sleeve can be secured any place along the cylindrical wall section so that the nipple extends through the wall with the sleeve section extending out beyond one side of the wall as described below to secure a washer against the walls surface.

Figure 2:
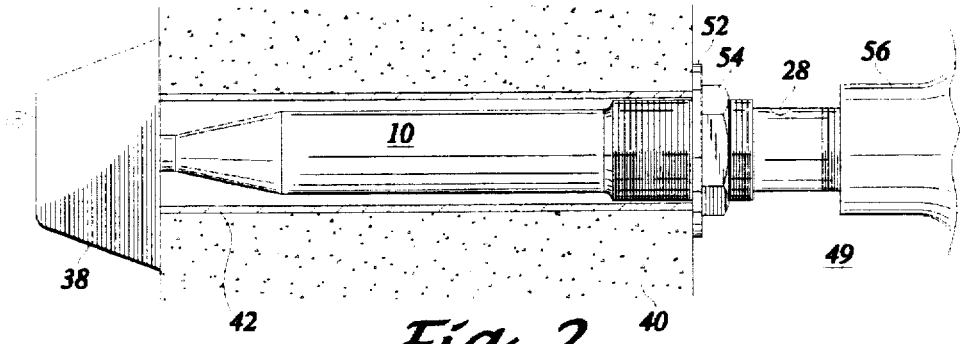
FIG. 2 is a side elevational view, partially in section, of the institutional sprinkler head and nipple assembly of the present invention mounted in a wall.

The nipple 10 is threadedly connected with the male threaded inlet of an institutional sprinkler head 38 as shown in FIG. 2. The nipple and sprinkler head are tightened to form a sealed connection and further tightened so that the paint spot 28 on the nipple is oriented in a specific way with the top of the sprinkler head. Institutional fire sprinkler heads must be mounted in a specific orientation in order to have the sprinkler head function properly. Accordingly, the nipple and sprinkler head are tightened so that the paint spot is always oriented in a specific manner with respect to the sprinkler head. Conveniently the paint spot is oriented with the top of the institutional sprinkler head. In this way, a single installer can secure the assembly of sprinkler head and nipple in an institutional wall without seeing the sprinkler head. The sprinkler head and nipple are assembled with the paint spot always oriented the same way with respect to the sprinkler head. An assembler then inserts the nipple through a bore 42 of an institutional wall 40. An assembler in the utility closet or pipe case 49 behind the wall will orient the sprinkler head by rotating the nipple to orient the paint spot and secure the sprinkler head in the wall by fitting a retainer washer 52 over the sleeve and then threading an internally threaded lock nut 54 onto the sleeve and tightening the nut firmly to place tension between the washer and nut and the sprinkler head. This prevents the sprinkler head assembly from being moved.

For existing institutions, the bore 42 can be drilled through the walls to provide a means for post fitting a sprinkler system into the institution. However, for new institutions, the bore can be conveniently created when the wall is created, such as by pouring concrete, by placing plastic conduit at the appropriate locations in the wall forms. The plastic liner prevents concrete from filling in the bore and permits the fire protection sprinkler system to be easily installed into the walls after the forms are removed. To prevent the nut 54 from being worked loose or free by movement of the sprinkler head; the nut 54 is conveniently a lock nut. Normally before the lock nut is tightened into place, the header system, of which only the fitting 56 is shown, is completed and the open end 19 of the nipple 10 is threadedly connected to the fixture 56. The nipple is threaded into the fittings so that the paint spot is oriented to a known orientation to provide that the sprinkler head is positioned properly. Thereafter, the lock nut is tightened down to tighten the flat washer against the surface of the wall to place the sprinkler had and the washer under tension.

Figure 3:
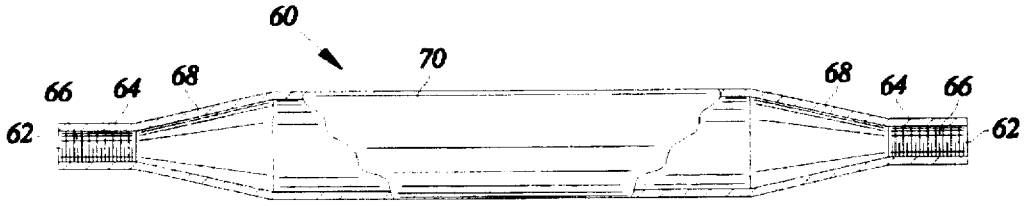
FIG. 3 is a side elevational view of a double swaged end pipe for fabricating single swaged end nipples.

The nipples are fabricated from swaged end nipples, conveniently they are fabricated from double ended swaged nipples such as shown in FIG. 3. The use of a swaged end nipple for the nipple shown in FIGS. 1 and 2, eliminates the necessity of having to use a reducing union between the nipple and the sprinkler head. As discussed above, Standards of the National Fire Protection Association requires that the nipple from the header have a nominal internal diameter of 1". Most sprinkler heads are fabricated with female inlets having a nominal internal diameter of ½". Some sprinkler heads have an internal diameter of ¾". If a constant diameter straight section nipple is used, such as the nipples presently used in the fire protection industry, a female threaded reducing union from 1" to ½" or ¾" must be utilized at the front end of the nipple, that is, the end to which the sprinkler head is attached. The use of reducing union requires that the bore 42 in the wall 40 be large enough to receive the union which has a substantially greater outer diameter than the nipple. The use of a reducing union between the end of the nipple and the sprinkler head requires additional labor to assemble the sprinkler head and the nipple. Another potential leakage path is provided by the threaded joint between the end of the nipple going into the reducing union. This exposed threaded joint is susceptible to corrosion and provides another point of weakness in the system both in strength and from leaks. The ideal system would be jointless, but that is not possible. The elimination of the reducing union, which the present invention does by using a swaged end nipple, reduces the fire protection sprinkler system susceptibility to corrosion and leaks by reducing, by almost a quarter, the number of joints in a system, and strengthens the system by eliminating a pipe fixture. The present nipple reduces the labor involved in installing fire sprinkler system in an institution by eliminating a reducing union and the need of a second installer to orient the institutional fire sprinkler head during installation as described above.

Since the assembly of the sprinkler head and the nipple are located in a bore in the wall, the connections between the reducing union and the nipple in the sprinkler head are not visible. In the present invention, with the elimination of the reducing union, only the connection between the sprinkler head and the nipple is not visible in the bore. However, by untightening the nut 54 the assembly of sprinkler head and nipple can then be moved out from the wall to ascertain the condition of the connection between the nipple and the sprinkler head. In contrast, when using a conventional nipple with the reducing union, the assembly of sprinkler head nipple would have to be removed much farther out from the wall in order to ascertain the condition of the connection between the sprinkler head and the union and the union and the conventional nipple.

The prior art sprinkler system assemblies include a header or branch line, a sprinkler head, and a conventional drop nipple. The conventional drop nipple provides communication between the header and the sprinkler head. Fire protection sprinkler systems typically include many headers and many sprinkler heads on each header. The headers and sprinkler heads are positioned in accordance with the conventional practice to provide complete coverage of the area to be protected.

The conventional drop nipple includes a substantially straight main pipe section which is of uniform diameter, both internal and external. In accordance with NFPA standards, the main pipe section is generally of 1" nominal internal diameter. In addition, sprinkler system lines, including the drop nipple assemblies, are formed of steel pipe in accordance with ASTM Designation: A 795 entitled "Standard Specification for Black and Hot-dipped Zinc-Coated (Galvanized) Welded and Seamless Steel Pipe for Fire Protection Use", which is incorporated by reference herein.

The main pipe section of the conventional nipple is typically provided with external threads on one end for the connection by means of a T-connector or other suitable threaded pipe connector to the header. The other end of the main pipe section is also provided with external threads for connection to a reducing union. The reducing union is female threaded on both sides and is threadedly connected to the inlet of a sprinkler head. The reducing union thus serves to take the diameter of the piping from that of the main pipe section (1 inch nominal) to that of the threaded inlet of the sprinkler head (generally ½").

Referring to FIG. 3, there is provided a double swaged end pipe 60 for forming nipples in accordance with the present invention. The pipe 60 includes a body portion 70 and two swaged ends 68 having a substantially smooth, uninterrupted reduction in internal diameter from the relatively larger diameter body portion 70 to the cylindrical outlet sections 64. The outlet sections have open outlets 62 and are internally threaded with female threads 66. The pipe 60 is cut to form two cylindrical pipes 12 used in the fabrication of the nipple 10, 88 and 108.

As mentioned above, during the installation of a fire protection sprinkler system, the drop nipples must be measured after the ceiling is substantially completed, taken out, cut off and threaded, supplied with the desired sprinkler head, and reconnected to the concealed header. The entire system may include hundreds of drop nipples, each of which must be cut to size depending upon the actual position of the ceiling proximate each.

The sprinkler system installer can cut a pair of drop nipples to the appropriate lengths from one double swaged end pipe 60. This potentially results in an overall savings of material, as when a relatively short drop nipple is required there remains additional length so that the opposite end of the double swaged end pipe 60 can be used where a relatively long drop nipple is required.

Figure 4:
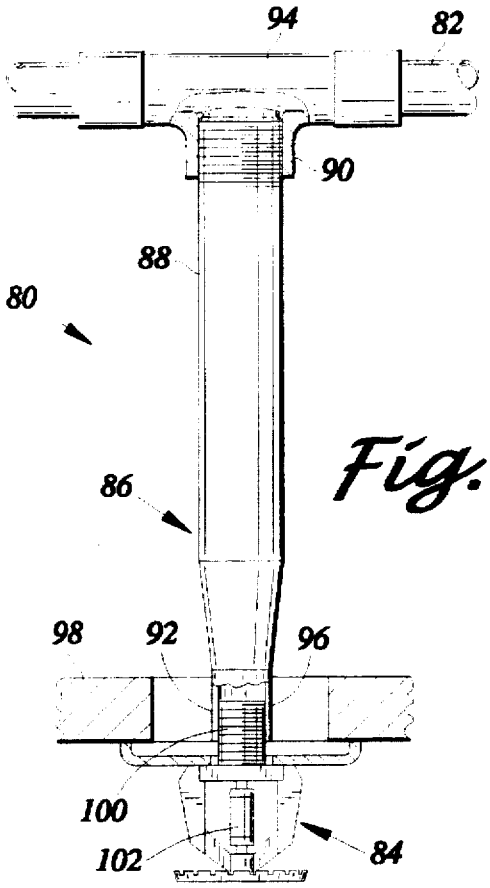
FIG. 4 is a side elevational view of the sprinkler head and drop nipple assembly including a swaged end drop nipple, sprinkler head and header in accordance with the present invention.

A ceiling mounted fire protection sprinkler system assembly in accordance with the present invention, generally designated 80, is illustrated in FIG. 4. The sprinkler system assembly 80 includes a header or branch line 82, a sprinkler head 84, and a drop nipple 86 providing communication between the header 82 and the sprinkler head 84. Sprinkler systems typically include many headers and many sprinkler heads on each header. The headers and sprinkler heads are positioned in accordance with the conventional practice to provide complete coverage of the area to be protected. While the system illustrated is a wet pipe system, the present invention is application to other types of fire protection sprinkler system.

The one-piece drop nipple 86 of the invention more particularly includes a hollow cylindrical body 88 and two ends 90 and 92 formed integrally therewith. The first end 90 is provided with external threads for connection by means of a T-connector 94 or other suitable threaded connector to the header 82. The cylindrical body 88 and first end 90 of the drop nipple 86 have a substantially uniform internal diameter. In accordance with NFPA standards, the main body 88 and first end 90 are generally of 1" nominal internal diameter.

The second end 92 of the drop nipple 86 is a cylindrical outlet section of reduced diameter which extends to the ceiling 98 and is provided with internal, tapered threads 96 for connection to the male threaded inlet 100 of the sprinkler head 84. The sprinkler head 84 is controlled by a conventional heat sensitive element 102 and may have any desired configuration and spray pattern.

To mate with the inlet 100 of the sprinkler head 84 (generally ½" diameter), the integral second end 92 of the drop nipple 80 is provided with an internal diameter which is significantly smaller than the internal diameter of the main body 88 and first end 90. Preferably, the drop nipple 86 is formed to include an integral second end 92 having a substantially smooth, uninterrupted reduction in internal diameter from the diameter of the main body 88 to the diameter required to properly mate with the inlet of the sprinkler head 84. The drop nipple 86, which is comprised of steel in accordance with ASTM A 759, is preferably swaged in a manner conventional in the metal forming art so that the integral second end 92 is provided with a substantially smooth, uninterrupted reduction in internal diameter.

The one-piece drop nipple 86 of the invention thus advantageously eliminates the need for a separate reducing union as required by conventional drop nipple assemblies. This results in a significant cost savings in material and labor over conventional sprinkler system drop nipples and reduces a potential source of leakage, the threaded connection between the conventional nipple and the reducing union.

In addition, the drop nipples of the present invention, by virtue of the substantially smooth, uninterrupted reduction in internal diameter provided therewith, cause relatively small hydraulic friction losses when compared with conventional drop nipples. The drop nipple provides a high efficiency low pressure drop, streamlined flow so that effective sprinkler head discharges are achieved.

Moreover as mentioned above, the drop nipple 86 eliminates the potential leak site previously present at the joint between the nipple and the reducing union of the conventional drop nipple assembly. This advantage is compounded since the corrosion susceptible outside diameter threading at the joint between the conventional nipple and the reducing union has also been eliminated by the present invention. The weakest, most corrosion susceptible point on the conventional drop nipple is at its very end. The drop nipple of the invention thus provides a more cost effective, efficient, reliable and a corrosion resistant sprinkler system than is currently available.

Figure 5:
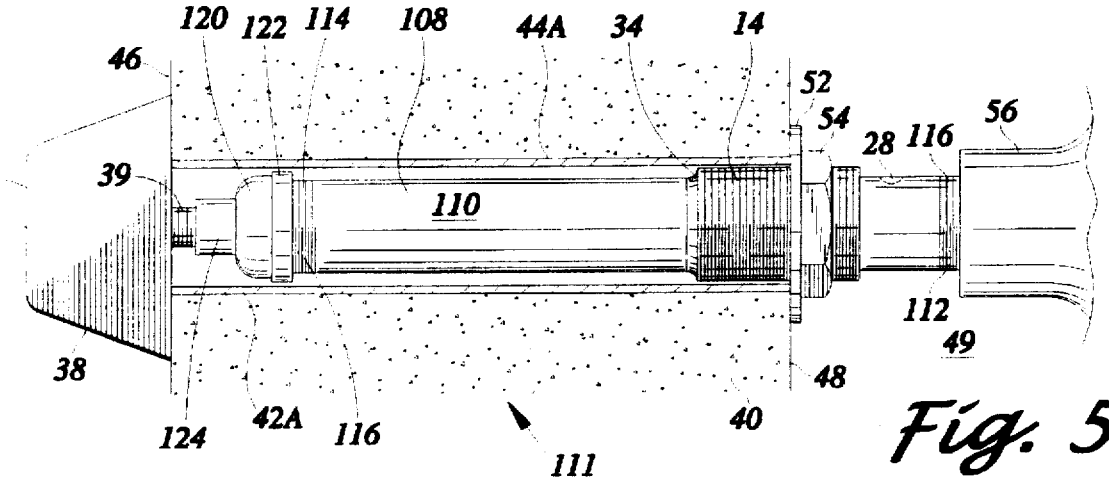
FIG. 5 is a side elevational view of an assembly of an institutional fire sprinkler head, an improved institutional sprinkler head nipple and a reducing coupler of the present invention installed in a wall.

Another embodiment of the invention is shown in FIG. 5. The improved institutional sprinkler head nipple 108 comprises a hollow pipe 110 having a substantially constant internal diameter and a constant external diameter. The pipe has an inlet end 112 which is connected to fire sprinkler fixtures 56 and an open outlet end 114 which is threadedly connected to a reducing coupler 120. The inlet end and outlet end both bear external threads 116. Reducing coupler 120 has an internally threaded inlet end 122 connected to the outlet end of hollow pipe 110 and an internally threaded outlet end 124 of smaller diameter than the inlet end. The externally threaded inlet 39 of institutional sprinkler head 38 is threadedly connected with the internally threaded outlet end 124 of the reducing coupler. For a sprinkler head having a ½" externally threaded inlet and a nipple having a 1" externally threaded outlet, a ½" to 1" internally threaded reducing coupler would be used. The hollow pipe 110 receives and secures an externally threaded sleeve 14 in the same manner that the improved nipple 10 receives and secures an externally threaded sleeve 14. The sleeve can be conveniently secured to the hollow pipe 110 by a weld bead 34. The hollow pipe 110 has a marker 28 near the inlet end 112 in the same manner that the improved nipple 10 has a marker 28 near its open inlet end 19.

The improved nipple 110 is threadedly connected with the reducing coupler 120 as shown in FIG. 5. The nipple and reducing coupler threaded connection is tightened to form a water tight connection. The internally threaded outlet end 124 of the reducing nipple is then threadedly connected to the externally threaded inlet 39 of the institutional sprinkler head and the threaded connection of the sprinkler head and reducing coupler is tightened to form a water tight connection. The sprinkler head and reducing coupler are further tightened so that the marker 28 on the nipple is oriented in a specific way with the top of the sprinkler head. As mentioned above, institutional fire sprinkler heads must be mounted in a specific orientation in order to have the sprinkler heads function properly. Conveniently the marker which is normally a paint spot is oriented with the top of the institutional sprinkler head. In this way, a single installer can secure the assembly 111 of a sprinkler head and nipple in an institutional wall with sprinkler head property oriented without seeing the sprinkler head or having a second installer orient the sprinkler head for the first installer as described above with respect to the assembly in FIG. 2. After the sprinkler head, reducing coupler and nipple are assembled, an installer inserts the assembly through a bore 42A of an institutional wall 40. An installer in the utility closet or pipe case 49 behind the wall will connect the assembly 111 to the fixture 56 of the fire sprinkler system and orient the sprinkler head by rotating the nipple to orient the paint spot and secure the sprinkler head in the wall by fitting the retainer washer 52 over the sleeve and threading an internally threaded lock nut 54 onto the sleeve and tightening the nut firmly to place tension between the washer and the nut and the sprinkler head. This prevents the sprinkler head assembly from being moved or jerked about. Because of the size of the reducing coupler 120, the bore 42A normally must be larger than the bore of 42 utilized to receive the improved nipple 10 described above with respect to FIG. 2.

The bore can be drilled through an existing wall, or alternatively, for a new institution when the concrete walls are poured, the bores can be pre-positioned by employing plastic or metal liners 44A as described above with respect to FIG. 2. To prevent the nut 54 from being worked loose or free by movement of the sprinkler head, the nut 54 is conveniently a lock nut. Before the lock nut is tightened into place, the header system of which only the fitting 56 is shown, is completed and the open inlet 112 of the nipple 108 is threadedly connected to the fixture 56. The nipple and the fitting are tightened to form a seal connection and then the nipple is further tightened to orient the marker 28 as described above. Thereafter, the lock nut is tightened down to tighten the flat washer against the surface of the wall 48 to place the sprinkler head residing against the surface of the wall 46 under tension. It can be appreciated, tremendous force or tension can be exerted by this means making the sprinkler head virtually impossible to move.

If the connection between the nipple or the sprinkler head and the reducing coupler needs to be inspected, the nut 54 can be loosened to give free play to the assembly 111 to permit the assembly to be pushed out beyond the wall surface 46 of the wall 40 to give the inspector an opportunity to inspect the connection of the nipple and the sprinkler head with the reducing coupler. As described herein, assembly illustrated in FIG. 2 has a number of advantages over the assembly 111 in FIG. 5. Assembly 111 has an additional connection which gives it a potential leak path. Because of the size of the reducing coupler, a larger bore is required to insert an assembly through an institutional wall. In addition, the fabrication of the assembly 111 requires an additional step and an additional pipe fixture since the assembler must use a reducing coupler and connect the sprinkler head to the end of the nipple employing the reducing coupler.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An improved fire sprinkler nipple comprising:

a cylindrical hollow pipe of a first inner diameter and a first outer diameter and having an open inlet end and an open outlet end, the wall of said pipe being swaged down toward the open inlet end to a cylindrical section of a second inner diameter less than the first inner diameter of said pipe, the open outlet end being internally threaded and adapted to receive an externally threaded inlet of an institutional fire sprinkler head, the open inlet end adapted to be joined with a fire sprinkler pipe fixture; and a cylindrical externally threaded sleeve of an internal diameter slightly greater than the first outer diameter of said cylindrical hollow pipe and having first and second ends, said sleeve received on and secured to said pipe proximate its inlet end, the first end of the sleeve facing the outlet end of said pipe, the sleeve adapted to receive a retaining washer and threaded nut.

2. The fire sprinkler nipple according to claim 1 wherein the open inlet end is externally threaded and adapted to be received within an internally threaded outlet of a fire sprinkler pipe fixture.

3. The fire sprinkler nipple according to claim 1 wherein the open inlet end is internally threaded and adapted to receive an externally threaded outlet of a fire sprinkler pipe fixture.

4. The fire sprinkler nipple according to claim 1 wherein the open inlet end is adapted to be connected to a grooved end/rubber casket type pipe coupling of a fire sprinkler pipe fixture.

5. The fire sprinkler nipple according to claim 1 wherein the sleeve is secured to said pipe by a weld.

6. The fire sprinkler nipple according to claim 5 wherein the weld is between the first end of said sleeve and the outlet end of said pipe.

7. The fire sprinkler nipple according to claim 1 wherein the sleeve is secured to said pipe by swaging said sleeve nears its first end into the outer surface of said pipe.

8. The fire sprinkler nipple according to claim 1 wherein said pipe has a marker on its outer surface between the second end of said sleeve and the inlet end of said pipe to determine the orientation of the nipple from the inlet end.

9. The fire sprinkler nipple according to claim 8 wherein the marker is a paint spot of contrasting color to the color of the outer surface of said pipe.

10. The fire sprinkler nipple according to claim 8 wherein the marker is a physical marker on the outer surface of said pipe.

11. An institutional fire sprinkler head assembly comprising an institutional fire sprinkler head having an externally threaded inlet; a nipple comprising a hollow pipe having a constant diameter cylindrical wall section with a open inlet end, a cylindrical outlet section having an open outlet end, and a swaged cylindrical wall section joining the cylindrical wall section and the cylindrical outlet section, said pipe being swaged down by the swaged cylindrical wall section to the cylindrical outlet section, the open outlet end being internally threaded and threadingly receiving the externally threaded inlet of said sprinkler head, the inlet end adapted to be joined to a fire sprinkler pipe fixture, and a hollow externally threaded sleeve received on and secured to the constant diameter cylindrical wall section of said pipe, the sleeve having a first end facing the open outlet end and a second end facing the open inlet end; a retainer washer removably received on said threaded sleeve; and an internally threaded nut threadingly received on said sleeve, the assembly adapted to be secured to a wall through a bore in wall wherein said institutional fire sprinkle head is positioned on one side of the wall about the bore, the nipple extending through bore to the other side of the wall, the washer positioned on the other side of the wall about the bore, and the assembly adapted to be secured to the wall by tightening the nut on the sleeve to place the sprinkler head and the washer in tension with respect to each other.

12. The fire sprinkler head assembly according to claim 11 wherein the inlet end is externally threaded and adapted to be received within an internally threaded fire sprinkler pipe fixture.

13. The fire sprinkler head assembly according to claim 11 wherein the inlet end is internally threaded and adapted to receive an externally threaded outlet of a fire sprinkler pipe fixture.

14. The fire sprinkler nipple according to claim 11 wherein the inlet end is adapted to be connected to a grooved end/rubber gasket type pipe coupling of a fire sprinkler pipe fixture.

15. The fire sprinkler head assembly according to claim 11 wherein the sleeve is secured to said pipe by welding.

16. The fire sprinkler head assembly according to claim 15 wherein the weld is between the first end of said sleeve and the outer surface of said cylindrical wall section.

17. The fire sprinkler head assembly according to claim 1 wherein the sleeve is secured to said pipe by swaging said sleeve nears its first end into the wall of said cylindrical wall section.

18. The fire sprinkler head assembly according to claim 17 wherein the cylindrical wall section has a marker on the outer surface of the cylindrical wall section between the second end of the sleeve and the open inlet end of the cylindrical wall section to indicate the orientation of the nipple and said institutional fire sprinkler head.

19. The fire sprinkler head assembly according to claim 18 wherein the marker is a paint spot of contrasting color to the color of the outer surface of the cylindrical wall section.

20. The fire sprinkler head assembly according to claim 18 wherein the marker is a physical marker on the outer surface of said pipe.

21. The fire sprinkler head assembly according to claim 11 wherein the internally threaded nut is a lock nut.

* * * * *